US008555822B2

(12) United States Patent
Huening

(10) Patent No.: US 8,555,822 B2
(45) Date of Patent: Oct. 15, 2013

(54) WASTE-HEAT BOILER FOR PARTICAL-LADEN GASES

(75) Inventor: Herbert Huening, Raesfeld (DE)

(73) Assignee: OSCHATZ GmbH, Essen (DE)

( * ) Notice: Subject to any disclaimer, the term of this patent is extended or adjusted under 35 U.S.C. 154(b) by 511 days.

(21) Appl. No.: 12/972,586

(22) Filed: Dec. 20, 2010

(65) Prior Publication Data

US 2011/0146595 A1 Jun. 23, 2011

(30) Foreign Application Priority Data

Dec. 19, 2009 (EP) ..... 09015761

(51) Int. Cl.
*F22B 37/24* (2006.01)

(52) U.S. Cl.
USPC ..... 122/511; 122/7 R

(58) Field of Classification Search
USPC ..... 122/7 R, 493, 511, 235.22, 262; 110/325; 165/134.1
See application file for complete search history.

(56) References Cited

U.S. PATENT DOCUMENTS 4,305,909 A * 12/1981 Willett et al. ..... 422/169
4,336,770 A * 6/1982 Kaneko et al. ..... 122/266
4,364,910 A * 12/1982 Willett et al. ..... 423/243.01
5,653,282 A * 8/1997 Hackemesser et al. .... 165/134.1

* cited by examiner

*Primary Examiner* — Gregory A Wilson
(74) *Attorney, Agent, or Firm* — Andrew Wilford

(57) ABSTRACT

A boiler for cooling waste gases has side walls including a pair of opposite side walls defining a passage through which the waste gases flow, cooling-tube sections in the passage against the walls, and at least one tubular tie rod having outer ends anchored in the opposite side walls and extending transversely through the passage, A coolant is pumped through the cooling-tube sections and through the tubular tie rod. The tie rod extends straight through the passage and is braced at its ends under tension against the opposite side walls.

17 Claims, 5 Drawing Sheets

9
8
23
P
7
10,21
6
5
2
7
6
21
7
10

WASTE-HEAT BOILER FOR PARTICAL-LADEN GASES

FIELD OF THE INVENTION

The present invention relates to a waste-heat boiler. More particularly this invention concerns such a boiler through which particle-laden waste gas passes.

BACKGROUND OF THE INVENTION

A standard waste-heat boiler has walls of with cooling-tube sections through which a coolant flows at a temperature $T_1$. The waste gas flowing through the boiler is thus cooled by the cooling-tube sections through which the coolant flows. The cooling-tube sections are generally each formed by a plurality of cooling tubes that run along the boiler walls. It is within the scope of the invention that these cooling tubes form the inner wall of the boiler.

Waste-heat boilers of this type are known in various embodiments from practice. During operation they are under a production-side superatmospheric pressure so that deformations or buckling of the boiler walls would result if no suitable countermeasures were taken. Under unfavorable conditions, upstream subatmospheric pressures also occur that have to be taken into consideration in the boiler design. In practice, the cited pressures cannot be absorbed by the walls of the waste-heat boiler alone. Therefore, the boiler walls are supported by braces bearing against the boiler walls. These braces are generally rolled steel profiles whose dimensions are determined by influencing variables such as gas pressure, spacing of the shapes and size of the areas to be cooled. In the case of waste-heat boilers with small outer dimensions and corresponding boiler geometry, the forces acting as a result of gas pressure can generally be absorbed and compensated by a brace system surrounding the boiler on the outside. To this end an exchange of forces takes place here inside the brace system and further system parts to transfer the forces are not normally necessary. In the case of larger outer dimensions of the boiler and/or if lower, funnel-shaped particle extractors are present, a continuous brace system for the respective boiler is no longer possible. Here discontinuous braces are provided and the acting forces are transmitted via these braces directly or indirectly via so-called cold braces into a cold steel construction surrounding the boiler. It must be thereby in particular be assured that thermal expansion of the boiler is not obstructed. With these systems, the force absorption or the equalization of forces thus takes place outside the brace system. Of course, the steel construction has to be designed for the acting gas pressures and the forces to be absorbed due to the gas pressure can amount to up to several hundred tons. This makes extremely complex steel constructions necessary.

OBJECTS OF THE INVENTION

It is therefore an object of the present invention to provide an improved waste-heat boiler.

Another object is the provision of such an improved waste-heat boiler that overcomes the above-given disadvantages, in particular where deformations in the boiler walls can be handled in a simple, effective and operationally reliable manner.

SUMMARY OF THE INVENTION

A boiler for cooling waste gases according to the invention has side walls including a pair of opposite side walls defining a passage through which the waste gases flow, cooling-tube sections in the passage against the walls, and at least one tubular tie rod having outer ends anchored in the opposite side walls and extending transversely through the passage, A coolant is pumped through the cooling-tube sections and through the tubular tie rod. The tie rod extends straight through the passage and is braced at its ends under tension against the opposite side walls.

The cooling-tube sections on the walls of the waste-heat boiler are advantageously formed by a plurality of cooling tubes. The coolant is fed to the cooling-tube sections or cooling tubes via at least one supply pipe. The coolant heated in the waste-heat boiler is carried away again via at least one return pipe. Adjacent cooling-tube sections are preferably connected to one another via bars.

According to the invention, the buckling of the walls of the boiler is avoided by means of at least one tubular tie rod. A tubular tie rod of this type is advantageously composed of metal, in particular of steel. It is advisable to use a plurality or a multiplicity of the tubular tie rods to stabilize a boiler. A coolant that also has the predetermined temperature flows through the at least one tie rod or the tie rods. The predetermined temperature of the coolant for the cooling tubes or the cooling-tube sections therefore corresponds or essentially corresponds to the predetermined temperature of the coolant for the at least one tubular tie rod. That the temperatures essentially correspond to one another means in particular that the temperature difference is not greater than 10° C., preferably not greater than 5° C. The coolant for the cooling tubes or the cooling-tube sections and/or the coolant for the at least one tubular tie rod, is advantageously boiling water.

It is within the scope of the invention that the cooling-tube sections run at least partially parallel to one another on the boiler walls. It is furthermore within the scope of the invention that at least a part or most of the cooling-tube sections extends transversely to the flow direction of the waste gas or transversely to the longitudinal direction of the boiler. Advantageously, adjacent cooling-tube sections are connected to one another via bars that are embodied continuously in the cooling-tube section longitudinal direction. According to a preferred embodiment, the boiler wall is thus formed by the cooling tubes or by the cooling-tube sections and the bars connecting them.

According to a particularly preferred embodiment of the invention, the waste-heat boiler is a horizontal waste-heat boiler, the longitudinal axis of which is arranged horizontally or essentially horizontally and through which the waste gas flows in its longitudinal direction, horizontally or essentially horizontally. As already stated above, the waste-heat boiler in particular is a waste-heat boiler for cooling particle-laden waste gases. Advantageously, the boiler then has in its lower region a particle extractor. In the case of a horizontal waste-heat boiler, the particle extractor also extends longitudinally of the waste-heat boiler.

It is within the scope of the invention that a plurality of the tie rods is distributed over the height and/or over the length of the boiler. Preferably, a plurality of the tie rods is connected in series and the coolant flows through these tie rods one after the other.

A very recommended embodiment of the invention is distinguished in that the coolant for the cooling-tube sections is used as a coolant for the tie rod/tie rods. Accordingly, therefore, a separate coolant is not used to cool the tie rods, but in effect a partial flow of the coolant for the cooling-tube sections is used to cool the tie rods. Preferably, a tie rod is connected to the supply pipe of the coolant for the cooling-tube sections and, after flowing through the tie rod or after flowing through a plurality of the tie rods connected in series, the coolant is conveyed into the return pipe of the coolant for the cooling-tube sections. It is within the scope of the invention that with tie rods connected in series, coolant flows in the opposite direction through two tie rods connected in series. Advantageously, therefore, the coolant flows through a tie rod connected to a supply pipe in a first direction, in a second opposite direction through the second tie rod connected to the first tie rod, and again in the first direction through a third tie rod connected to the second tie rod, etc.

According to the recommended embodiment, a plurality of the tie rods is distributed one above the other over the height of the boiler and this plurality of the tie rods is in particular in a planar vertical array or essentially in a planar vertical array. Preferably, a plurality of vertical arrays or essentially vertical arrays each with a respective plurality of the tie rods arranged one above the other is arranged one downstream of the other longitudinally of the boiler. Advantageously, two vertical arrays or two essentially vertical arrays with tie rods arranged one above the other are thereby connected in series and are flowed through successively by the coolant. It is within the scope of the invention that two tie rods flowed through successively are connected to one another via a connector tube running on the outside of the boiler.

It is furthermore within the scope of the invention that the waste gas in the boiler is under a pressure of 50 to 200 mbar, in particular under a pressure of 70 to 190 mbar. As is recommended, braces are arranged outside the boiler or the boiler walls, on which braces the boiler walls can be supported. Preferably, the boiler walls are fixed to the braces such that in the event of movements or expansions of the boiler walls, the braces also move or expand with them. Advantageously, the braces are steel shapes and in particular rolled steel shapes. It is advisable to orient the braces horizontally and/or vertically. In the case of a horizontal waste-heat boiler preferably used, advantageously horizontally oriented braces are provided that run parallel to the longitudinal axis of the boiler as well as vertically oriented braces that run perpendicular to the longitudinal axis of the boiler.

It is furthermore within the scope of the invention that a tubular tie rod engages through the two opposite boiler walls connected by the tie rod and thus projects outside the two boiler walls. Advantageously, at least one outwardly projecting tie-rod section is connected via a connector tube running along the outside of the boiler to a further tie rod or to a tie-rod section, projecting on the outside of the boiler. It is thus within the scope of the invention that a tie rod has a middle section in the boiler from the one boiler inside wall to opposite the boiler inside wall and outside each of the two boiler walls lying opposite respectively an outwardly projecting end tie-rod section. Advantageously, a tie rod engaging through a boiler wall is not fixed to the boiler wall. The boiler wall can thus move or expand relative to the tie rod.

A particularly preferred embodiment of the invention is characterized in that at least one support flange is fixed on a tie rod engaging through a boiler wall or on a tie-rod section of this tie rod projecting from the outside of the boiler wall, on which support flange an external brace can be supported. Advantageously, this is a support flange of metal that is welded to the metallic tie-rod end section. It is within the scope of the invention that at least one support flange is fixed on the tie-rod end sections, respectively projecting outward from both opposite boiler walls, of the tie rod.

According to a particularly recommended embodiment, a first support flange is fixed on a tie rod or on a tie-rod section, projecting from the outside of the boiler wall, of the tie rod, on which first support flange the brace can be supported on outward movement of the boiler wall due to superatmospheric pressure in the boiler, and a second support flange is fixed on this tie rod or on the cited projecting tie-rod section, on which second support flange the brace can be supported on inward movement of the boiler wall due to subatmospheric pressure in the boiler. That a support flange is fixed on a tie rod or a tie-rod section means within the scope of the invention in particular that the support flange is securely connected to the tie rod or the tie-rod section and cannot make any relative movement to the tie rod or to the tie-rod section. Preferably, a fixed support flange of this type is welded onto the tie rod or the tie-rod section. Advantageously, the two support flanges of a projecting tie-rod section are embodied as support plates parallel to one another. It is within the scope of the invention that the two cited support flanges are fixed on each side of the boiler on the tie-rod sections, projecting outward there, of the tie rod.

According to a recommended embodiment variant of the invention, a contact plate is fixed on a brace to be supported on the at least one support flange, and the brace can be supported via this contact plate on the at least one support flange. Advantageously, the contact plate is metallic and welded on the metallic brace. As is recommended, the contact plate projects into a space between the two support flanges preferably fixed on a tie-rod section projecting outward. Preferably, this contact plate is arranged in quasi neutral state at a spacing from each of the two support flanges of a tie-rod section. Preferably, the cited tie-rod section engages through the contact plate so that the contact plate is moveable relative to the tie-rod section. On outward movement of the boiler walls due to superatmospheric pressure in the boiler, the boiler wall assigned to the cited brace moves outward with the brace and the brace can be supported via the contact plate on the outer support flange of the tie-rod section. On inward movement of the boiler walls due to subatmospheric pressure in the boiler, the boiler wall moves with the connected brace toward the boiler interior and the brace can then be supported via the contact plate on the innermost of the two support flanges of the tie-rod section. It is within the scope of the invention that on inward or outward movement of the boiler walls, a boiler wall moves with an assigned brace relative to an assigned tie rod. The boiler wall and brace thus move jointly, while the assigned tie rod or the assigned tie rods do not perform any movement or do not essentially perform any movement. It is otherwise within the scope of the invention that the arrangements or embodiments of the support flanges and/or the contact plate described as preferred above on both sides of the boiler are realized on the tie-rod sections, respectively projecting outward, of a tie rod.

According to a preferred embodiment of the invention, a tie rod engaging through a boiler wall or the tie-rod section projecting outward from the boiler wall has a sealing jacket that surrounds the tie-rod section in a gas-tight manner. It has already been pointed out that a tie rod preferably engages through a boiler wall without fixing. Gas can escape outward through the corresponding opening of the boiler wall. To prevent this gas from leaking out to the environment, the preferred sealing jacket is arranged around the tie-rod section projecting outward. Advantageously, the sealing jacket on the one hand is fixed on the boiler wall in a gas-tight manner and on the other hand is fixed on a support flange of the tie-rod section in a gas-tight manner. The sealing jacket is preferably composed essentially of metal and in particular essentially of steel. Preferably, the sealing jacket is welded in a gas-tight manner to the boiler wall on the one hand and to a support flange on the other hand. According to a recommended embodiment, a sealing jacket of this type has a compensator that permits inward and/or outward movement of the boiler wall relative to the support flange.

The invention is based first on the discovery that with the waste-heat boiler according to the invention buckling or deformations of the boiler walls due to gas superatmospheric pressure or also to gas subatmospheric pressure can be clearly reduced in an easy, effective and operationally reliable manner. The invention is furthermore based on the discovery that it is useful if the tie rod used according to the invention is cooled with the coolant to the same temperature as the cooling-tube sections forming the boiler walls. In this manner differential expansions or deformations of the boiler walls can be reduced effectively. The tie rods used according to the invention can withstand high tensions so that the invention can be realized with an advantageously low use of material. The number of tie rods to be used is determined solely by the size of the boiler walls to be reinforced. It should be emphasized that the measures according to the invention in particular are suitable for large waste-heat boilers and/or for waste-heat boilers with particle extractors, in which continuous brace systems are not possible. With these waste-heat boilers without a continuous brace system, according to the invention a complex support of the waste-heat boiler on a complex external steel construction is advantageously no longer necessary. In the event of superatmospheric pressure or subatmospheric pressure in the boiler, the force equalization to reduce the deformations on the waste-heat boiler takes place inside the brace system of the waste-heat boiler. The invention is furthermore based on the discovery that the coolant present anyway for cooling the boiler walls also can be used for cooling the tubular tie rods according to the invention. It should be emphasized that the success according to the invention can be realized easily and with low expenditure as well as with cost-effective measures. This is helped by the fact that the tie rods do not need to be fixed or do not need to be welded to the boiler walls.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
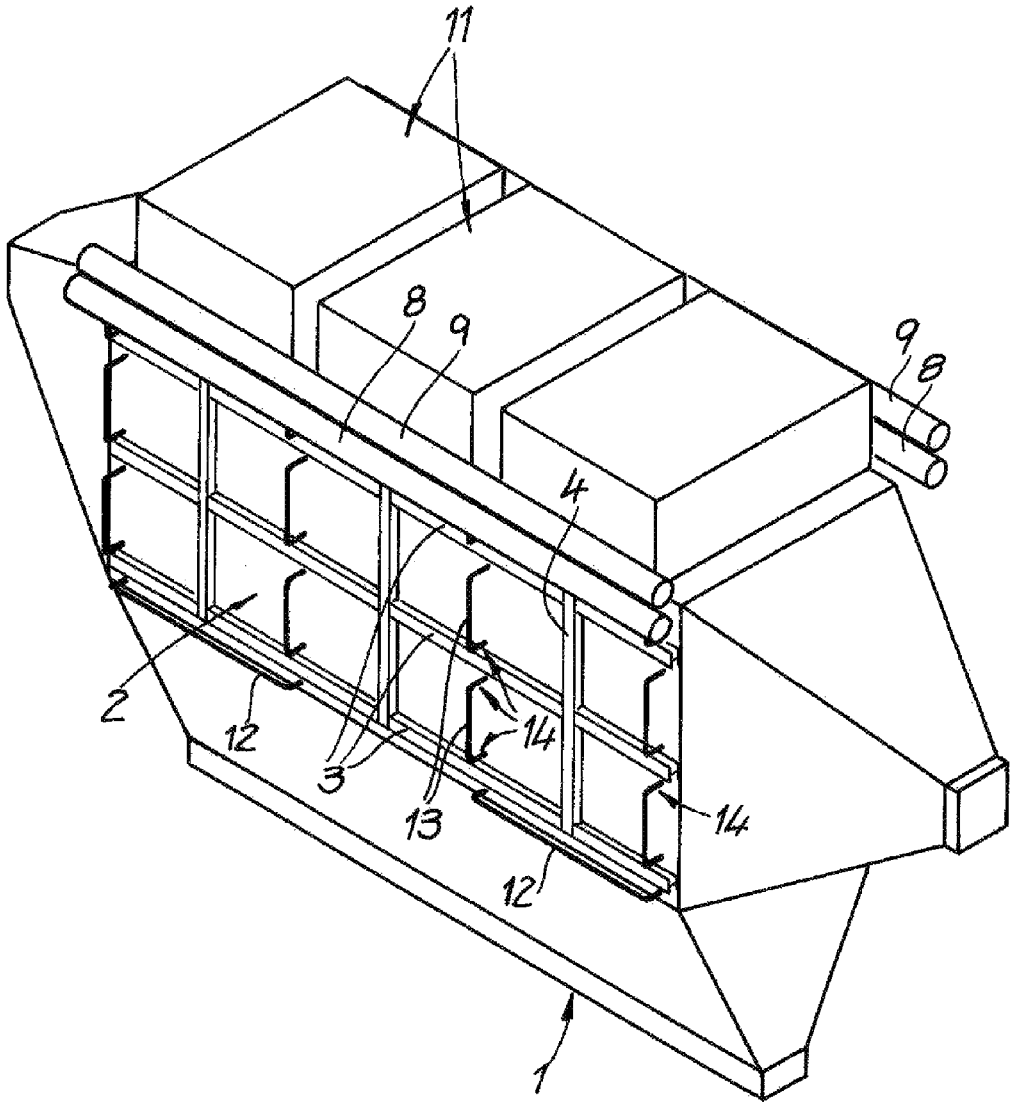
FIG. 1 is a perspective view of a waste-heat boiler according to the invention.
Figure 2:
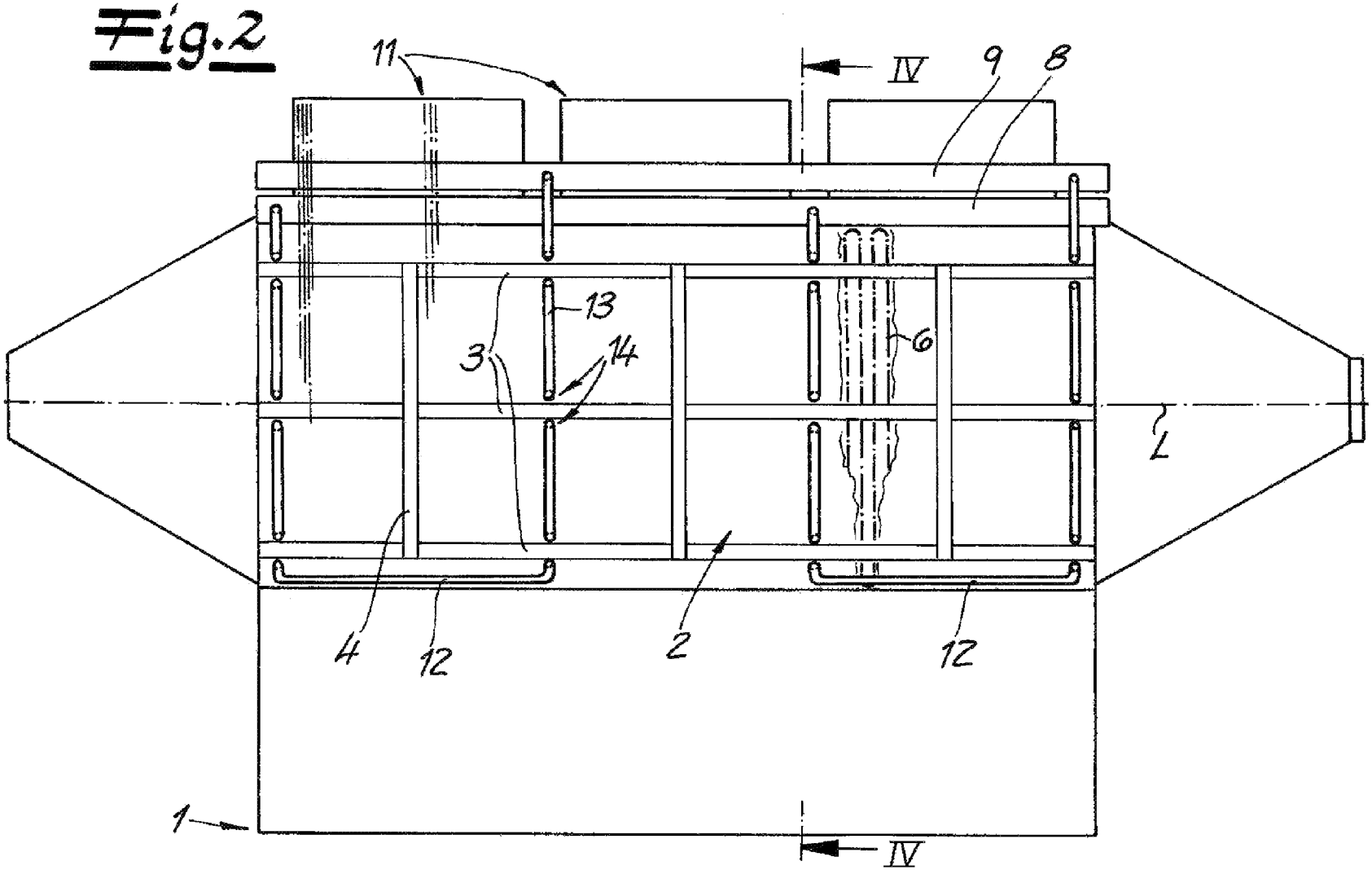
FIG. 2 is an end view of the boiler of FIG. 1.
Figure 4:
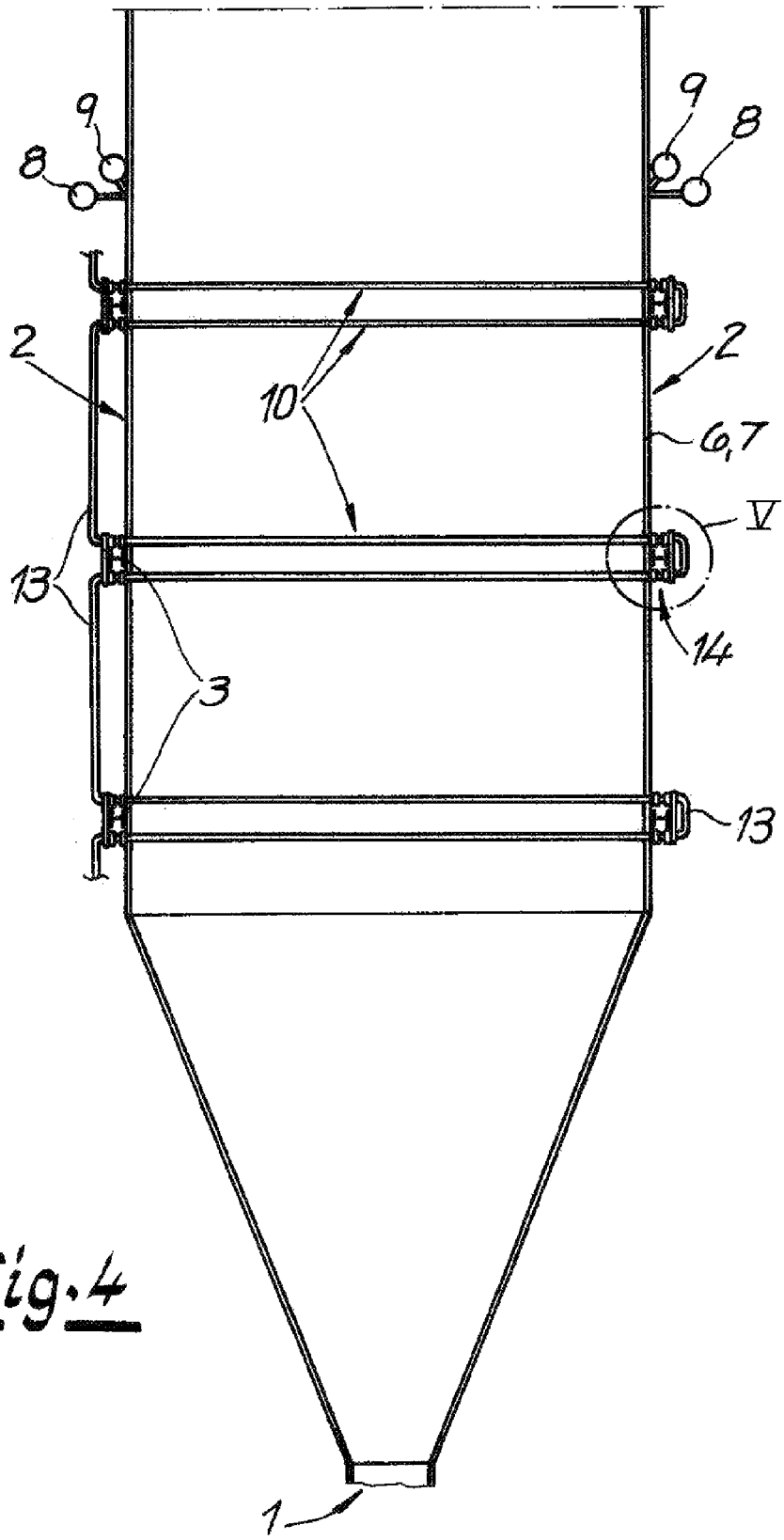
FIG. 4 is section IV-IV through the structure of FIG. 2.

As seen in FIGS. 1, 2 and 4, the preferred embodiment the waste-heat boiler according to the invention is a horizontal waste-heat boiler through whose passage waste gas flows longitudinally or horizontally. This horizontal waste-heat boiler has a funnel-shaped particle extractor 1 mounted in the lower part of the boiler. In the illustrated embodiment it may be a waste-heat boiler with relatively large dimensions. In the case of a waste-heat boiler of this type, provision of a continuous brace system is not possible. Therefore with this waste-heat boiler, horizontal braces 3 and vertical braces 4 explained in more detail below are provided only on the side boiler walls.

The boiler walls 2 of the waste-heat boiler have cooling-tube sections 5 that are formed by cooling tubes 6 through which a coolant flows at a temperature $T_1$. The cooling-tube sections 5 are preferably and in the illustrated embodiment connected together by bars 7. The boiler walls 2 are thus formed essentially by the cooling tubes 6 or by the cooling-tube sections 5 and the bars 7. In the illustrated embodiment a supply pipe 8 is provided to supply the coolant and a return pipe 9 is provided to carry off the heated coolant, both being connected to a pump shown schematically at 23. Boiling water is preferably used as coolant.

According to the invention, opposite walls 2 of the boiler are connected to one another by tubular tie rods 10. Coolant at the temperature $T_1$ also flows through the tubular tie rods 10. Preferably and in the illustrated embodiment the coolant for the tube arrays 5 is also used as a coolant for the tubular tie rods 10. To this end, the tie rods 10 or the tie rod units explained below are also connected to the supply pipe 8 and to the return pipe 9 for the coolant.

As is recommended and in the illustrated embodiment, a plurality of the tie rods 10 are distributed over the height and over the length of the boiler. In the illustrated embodiment, six tie rods 10 are distributed over the height of the boiler in a planar vertical array. These vertically aligned tie rods 10 are connected in series and the coolant flows through the tie rods 10 of a vertical array after the other. Preferably and in the illustrated embodiment, a plurality of vertical arrays each with six respective tie rods 10 one above the other are spaced one after the other longitudinally of the boiler. The vertical arrays with the tie rods 10 one above the other are between cooling tube bundles 11 that project into the interior of the boiler to cool the waste gas. In the illustrated embodiment, a pair of vertical arrays each with six tie rods 10 one above the other are connected in series and the coolant flows through them one after the other. Advantageously and in the illustrated embodiment, the lower tie rods 10 of each pair of vertical arrays are connected to one another via a tube section 12 running longitudinally on the outside of the boiler. Preferably and in the illustrated embodiment, the upper tie rod 10 of the upstream vertical array of each pair of arrays is connected to the supply pipe 8 and the upper tie rod 10 of the downstream vertical array of each pair of arrays is connected to the return pipe 9. Advantageously and in the illustrated embodiment, two adjacent tie rods 10 flowed through successively are connected to one another via a connector tube 13 running vertically along the outside of the boiler. Two tie rods 10 flowed through successively are otherwise flowed through by the coolant in the opposite direction.

The gas pressure in the waste-heat boiler can be 50 to 200 mbar during operation of the boiler. As already stated above, braces 3 and 4 are mounted outside the boiler walls 2 for stabilization, against which braces the boiler walls are supported. Preferably and in the illustrated embodiment, horizontal braces 3 oriented parallel to the longitudinal axis L of the boiler are provided, as well as vertically oriented braces 4. In the illustrated embodiment, the vertical braces 4 are centered on the cooling tube bundle 11. The braces 3 and 4 are in particular steel profiles and, in the illustrated embodiment, double-T-beams.

Figures 3, 3A:
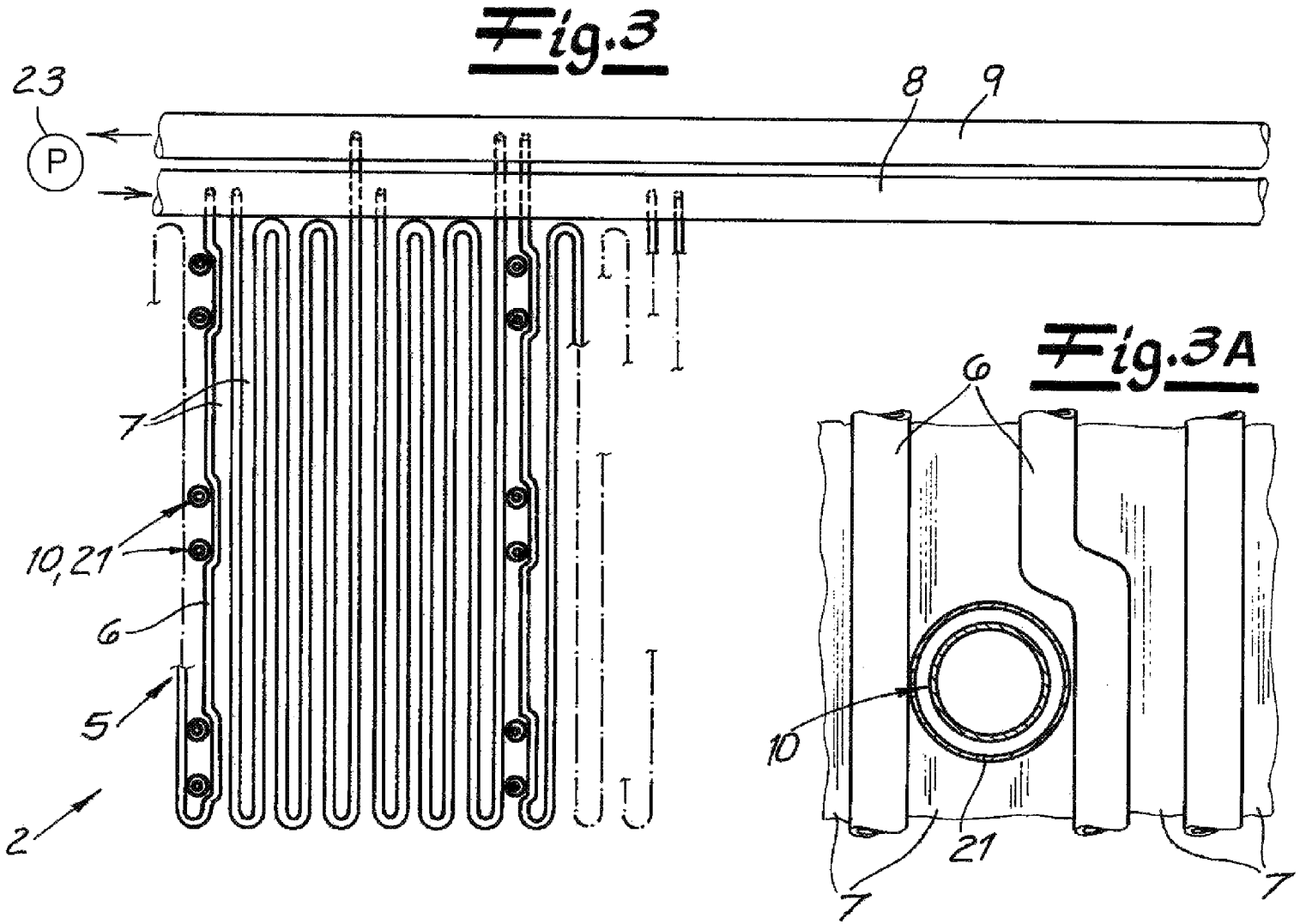
FIG. 3 is an enlarged section from FIG. 2.
FIG. 3A is a further enlarged detail of FIG. 3.
Figure 5:
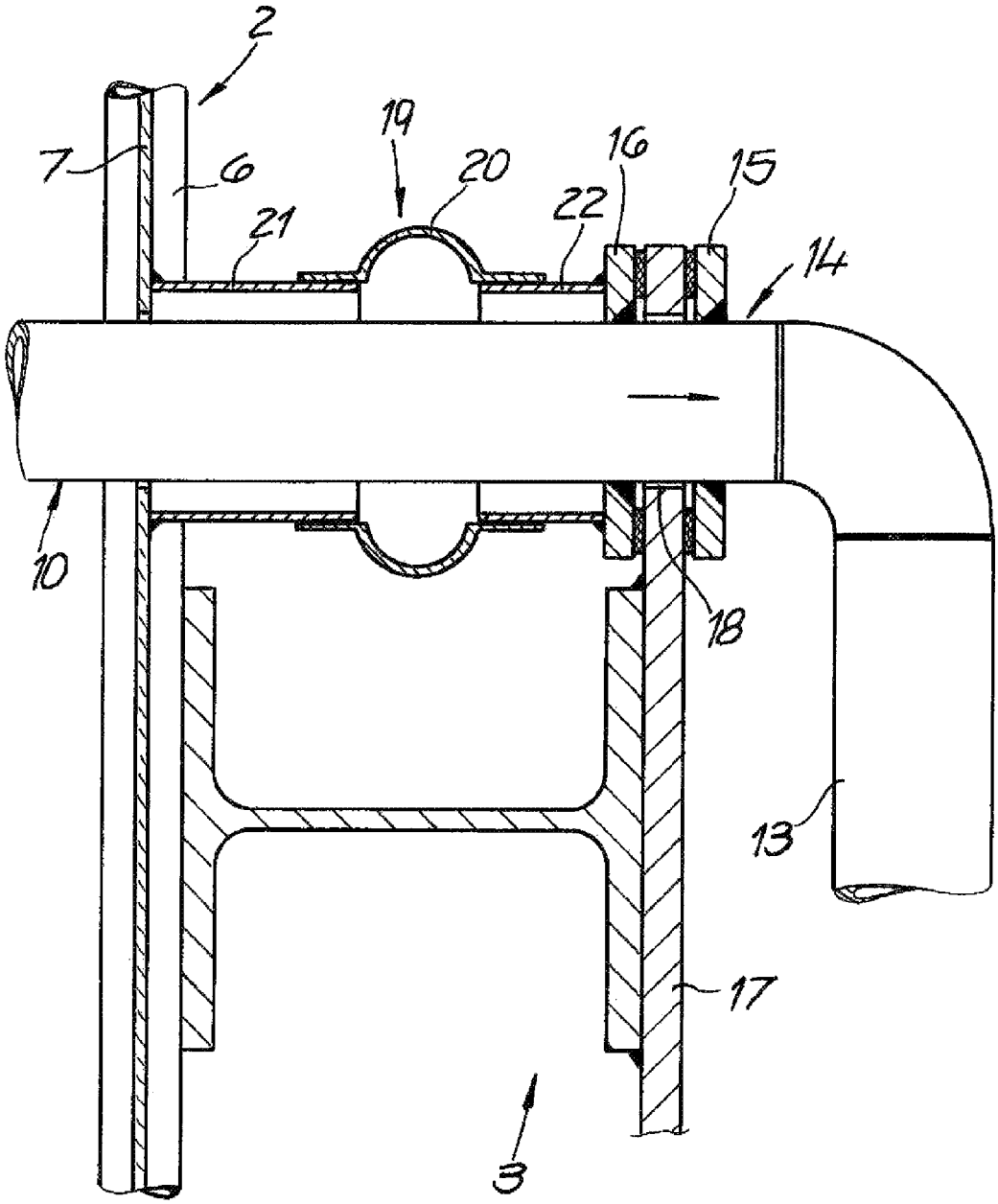
FIG. 5 is a large-scale view of the detail indicated at V in FIG. 4.

Above all FIGS. 3 through 5 show that the tubular tie rods 10 each engage through the two opposite boiler walls 2 that they interconnect. The enlarged section of FIG. 3 shows that a cooling-tube section 5 is locally cut out on an end in order to make room for a tie rod 10 engaging through the boiler wall 2. It is thereby within the scope of the invention that the tie rods 10 engage through the boiler walls 2 without being fixed to the boiler wall 2. Advantageously and in the illustrated embodiment, a tie rod 10 thus is longer than the section extending in the boiler from one boiler wall 2 to the opposite boiler wall 2 and have tie-rod sections 14 projecting outward from the boiler on both sides of the boiler and secured by anchor assemblies outside the boiler.

This anchor assembly has two support flanges 15 and 16 that are fixed, preferably welded, onto each of the sections 14 projecting outward from the boiler of the tie rods 10. The is support flanges 15 and 16 are therefore not moveable relative to the respective tie-rod section 14. According to the recommended embodiment and in the illustrated embodiment, the horizontal braces 3 fixed onto the boiler walls 2 can be supported on the adjacent tie rods 10 or on the support flanges 15 and 16 of the adjacent tie rods 10. FIG. 5 shows that a contact plate 17 is fixed, preferably welded, onto a horizontal brace 3 for support on an adjacent tie rod 10, which contact plate 17 has a hole 18 that engages with clearance around the respective tie-rod section 14. The contact plate 17 is thus moveable relative to the tie-rod section 14. Furthermore, each contact plate 17 engages into a space between the two respective support flanges 15 and 16 and has in the quasi neutral state a spacing from the outer support flange 15 as well as from the inner support flange 16. Since the braces 3 and 4 are fixed on the boiler walls 2, the horizontal braces 3 and thus also the contact plates 17 fixed thereto move with the boiler walls 2. When the boiler walls 2 move outward due to a superatmospheric pressure in the boiler, the horizontal braces 3 also move and then a contact plate 17 fixed to a horizontal brace 3 can be supported on the outer support flange 15 of a tie-rod section 14. Due to this support taking place on both sides of the boiler of the contact plates 17 or the horizontal braces 3 on the outer support flanges 15, the forces occurring with superatmospheric pressure in the boiler can be effectively absorbed by the tie rods 10. The force equalization thus takes place effectively in the brace/tie rod system and a is complex external steel construction to transfer the forces is no longer necessary. With inward movement of the boiler walls 2 and the braces 3 and 4 fixed thereto due to a subatmospheric pressure in the boiler, the horizontal braces 3 can be supported via the contact plates 17 on the inner support flanges 16 and the described effective transfer of force into the tie rod takes place here too.

It has already been stated above that the tie rods 10 engage through the boiler walls 2 without fixing to the boiler walls 2, in particular without welding to the boiler walls 2. This makes possible movements or expansions of the boiler walls 2 relative to the tie rods 10. Gas from the boiler can reach the outside through spaces or gaps between a boiler wall 2 and a tie rod 10. According to a particularly preferred embodiment and in the illustrated embodiment, each tie-rod section 14 projecting from a boiler wall 2 for sealing has a respective sealing jacket 19 that surrounds the projecting tie-rod section 14 in a gas-tight manner. The sealing jacket 19 preferably and in the illustrated embodiment is composed essentially of metal or steel. As is recommended, the sealing jacket 19 is fixed, in particularly welded, at one end in a gas-tight manner to the respective boiler wall 2 and is fixed, in particular welded, at the other in a gas-tight manner on the inner support flange 16. In this manner an operationally reliable seal is ensured at the points at which the tie rods 10 engage through the boiler walls 2. FIG. 5 shows that preferably and in the illustrated embodiment a compensator 20 is arranged between the two sections 21 and 22 of a sealing jacket 19. This compensator 20 may be a gas-tight compensator of a woven fabric. This compensator 20 compensates forces that occur with movements of the boiler wall 2 and the sealing jacket section 21 fixed thereto relative to the tie rod 10 and the sealing jacket section 22 connected thereto via the inner support flange 16.

I claim:

1. A boiler for cooling waste gases, the boiler comprising:

side walls including a pair of opposite side walls defining a passage through which the waste gases flow;

cooling-tube sections in the passage;

at least one tubular tie rod having outer ends anchored in the opposite side walls and extending transversely through the passage; and means for flowing a coolant through the cooling-tube sections and through the tubular tie rod.

2. The waste-heat boiler defined in claim 1 wherein the tie rod extends straight through the passage and is braced at its ends under tension against the opposite side walls.

3. The waste-heat boiler defined in claim 1 wherein the side walls are vertical and the passage and tie rod are horizontal.

4. The waste-heat boiler defined in claim 3 wherein there are a plurality of such tie rods spaced horizontally and vertically apart along the passage in a plurality of arrays each having a respective plurality of the tie rods.

5. The waste-heat boiler defined in claim 4, further comprising conduit means connecting the tubular tie rods together in series such that the coolant flows through them one after another.

6. The waste-heat boiler defined in claim 5 wherein the same coolant is passed through the tie rods as through the cooling-tube sections.

7. The waste-heat boiler defined in claim 5 wherein the tubes of each array lie in a respective substantially vertical plane with the respective tubular tie rods horizontal.

8. The waste-heat boiler defined in claim 7 wherein the arrays are substantially parallel to and spaced horizontally from one another in a flow direction of the waste gases through the passage.

9. The waste-heat boiler defined in claim 8, further comprising at least one tube bundle in the passage and through which the waste gases flow, the tube bundle being flanked by a respective pair of the tie-rod arrays including an upstream array and a downstream array, the means flowing the coolant through one of the upstream and downstream arrays and then in series through the other of the upstream and downstream arrays.

10. The waste-heat boiler defined in claim 1, further comprising rigid braces fixed on outside faces of the opposite side walls.

11. The waste-heat boiler defined in claim 10 wherein each tie rod has a pair of outer ends, the boiler further comprising anchors fixing each of the outer ends to a respective one of the braces.

12. The waste-heat boiler defined in claim 11 wherein each of the outer ends is provided with and fixed to at least one respective outwardly projecting flange, the anchors being braced against the respective flange.

13. The waste-heat boiler defined in claim 12 wherein each outer end is provided with two such flanges including an inner flange and an outer flange spaced therefrom, the respective anchor including a contact plate engaged between the flanges and fixed on the respective brace.

14. The waste-heat boiler defined in claim 13 wherein each inner flange and the respective outer flange spacedly flank the respective contact plate.

15. The waste-heat boiler defined in claim 13 wherein each contact plate is formed with a throughgoing hole through which the respective tie rod passes and that spacedly surrounds the respective tie rod.

16. The waste-heat boiler defined in claim 13, further comprising a respective tubular and length-adjustable jacket surrounding each of the tie-rod outer ends outside the boiler and having an inner end fixed to the outer face of the respective side wall and an outer end fixed to the respective inner flange.

17. The waste-heat boiler defined in claim 16 wherein the ends of each jacket are formed by respective rigid tube sections and each jacket includes a length adjustable sleeve between the respective tube sections and engaged in a gas-tight fit therewith.

* * * * *